US009680258B2

(12) United States Patent
Underwood

(10) Patent No.: US 9,680,258 B2
(45) Date of Patent: Jun. 13, 2017

(54) PLUG COMPRISING A PIN PIVOTED OUT OF A SOCKET

(75) Inventor: Geoffrey Paul Underwood, Newport (GB)

(73) Assignee: IFPL GROUP LIMITED, Newport (GB)

( * ) Notice: Subject to any disclaimer, the term of this patent is extended or adjusted under 35 U.S.C. 154(b) by 247 days.

(21) Appl. No.: 14/007,424

(22) PCT Filed: Mar. 16, 2012

(86) PCT No.: PCT/GB2012/050589
§ 371 (c)(1),
(2), (4) Date: Oct. 20, 2014

(87) PCT Pub. No.: WO2012/131324
PCT Pub. Date: Oct. 4, 2012

(65) Prior Publication Data

US 2015/0099401 A1 Apr. 9, 2015

(30) Foreign Application Priority Data

Mar. 25, 2011 (GB) ..... 1105064.8

(51) Int. Cl.
*H01R 24/38* (2011.01)
*H01R 13/635* (2006.01)
(Continued)

(52) U.S. Cl.
CPC ..... *H01R 13/635* (2013.01); *H01R 13/633* (2013.01); *H01R 24/38* (2013.01);
(Continued)

(58) Field of Classification Search
CPC .... H01R 13/633; H01R 13/635; H01R 27/00; H01R 2105/00
(Continued)

(56) References Cited

U.S. PATENT DOCUMENTS 4,010,995 A * 3/1977 Britschgi ..... H01R 13/633 439/152
4,415,219 A 11/1983 Kuhl et al.
(Continued)

FOREIGN PATENT DOCUMENTS

DE 699713 12/1940
FR 2659502 * 9/1991 ..... H01R 13/633
(Continued)

OTHER PUBLICATIONS

Bernier, Quick Disconnect Connection Device, 1991, FR2659502, Translation.*
(Continued)

*Primary Examiner* — Amy Cohen Johnson
*Assistant Examiner* — Milagros Jeancharles
(74) *Attorney, Agent, or Firm* — Nelson Mullins Riley & Scarborough LLP

(57) ABSTRACT

A plug (1) for electrical equipment, the plug comprising a pin (2) and the pin comprising an electrical terminal contact, the plug further comprising a housing (3), the plug arranged to be received in a socket (10), wherein the pin and the housing configured to enable the pin to be pivoted out of the socket by way of a force applied to a cable entry region of the plug by a cable attached to the plug.

12 Claims, 3 Drawing Sheets

(51) Int. Cl.
*H01R 13/633* (2006.01)
*H01R 24/76* (2011.01)
*H01R 27/00* (2006.01)
*H01R 105/00* (2006.01)

(52) U.S. Cl.
CPC ..... *H01R 24/76* (2013.01); *H01R 27/00* (2013.01); *H01R 2105/00* (2013.01)

(58) Field of Classification Search
USPC ..... 439/372, 660, 668, 669, 692, 924.1
See application file for complete search history.

(56) References Cited

U.S. PATENT DOCUMENTS 4,857,014 A * 8/1989 Alf ..... H01R 9/0518 439/578
6,406,313 B1 * 6/2002 Victor ..... H01R 27/00 439/175
6,634,896 B1 * 10/2003 Potega ..... G01K 1/02 374/E1.002
7,226,319 B2 * 6/2007 Woo ..... H01R 24/58 439/668
7,407,416 B1 * 8/2008 Rogers ..... H01R 24/58 439/669
7,736,193 B2 * 6/2010 Edeler ..... H01R 24/58 439/188
8,079,880 B2 * 12/2011 Lin ..... H01R 13/631 439/668
8,142,231 B2 * 3/2012 Tung ..... H01R 13/2442 439/660
2004/0038593 A1 * 2/2004 Siddiqui ..... H01R 24/58 439/668
2011/0244724 A1 * 10/2011 Whitlock ..... H01R 24/38 439/580

FOREIGN PATENT DOCUMENTS

JP 4177693 B2 11/2008
NL 1019789 C2 7/2003
WO 0021161 4/2000
WO 01/15286 A1 3/2001

OTHER PUBLICATIONS

International Search Report—PCT/GB2012/050589.
United Kingdom Search Report—GB1105064.8.
European Patent Office, Communication pursuant to Article 94(3) EPC regarding Application No. 12716066.1, dated Apr. 13, 2015, pp. 1-5.

* cited by examiner

PLUG COMPRISING A PIN PIVOTED OUT OF A SOCKET

CROSS-REFERENCES TO RELATED APPLICATIONS

This application claims the benefit of Great Britain Patent Application No. 1105064.8, filed Mar. 25, 2011, and corresponding International Patent Cooperation Treaty Application No. PCT/GB2012/050089, filed Mar. 16, 2012, each herein incorporated by reference.

TECHNICAL FIELD

The present invention relates generally to electrical connectors, and in particular, although not exclusively, to plugs and jacks for use with electrical equipment, such as headsets.

BACKGROUND

Jack and plug connectors are known to enable a user equipment, such as headphones, to be connected to a host equipment, such as a passenger entertainment system. Whilst the plug is inserted in the jack it is possible that the user will move the headphones relative to the point of connection between the plug and the jack. If the user attempts to move the headphones beyond the length of the cable (which connects the plug to the headphones) a force will be applied to the plug and the jack by the cable. This means that cable, the jack and/or the plug could be damaged as a result of the force applied.

We have realised that it would be advantageous to provide an improved electrical connector.

SUMMARY

According to one aspect of the invention there is provided a plug for electrical equipment, the plug comprising a pin and the pin comprising an electrical terminal contact, the plug further comprising a housing, the plug arranged to be received in a socket, wherein the pin and the housing configured to enable the pin to be pivoted out of the socket by way of a force applied to a cable entry region of the plug by a cable attached to the plug.

According to a second aspect of the invention there is provided socket for use with the plug of the first aspect of the invention.

According to a third aspect of the invention there is provided a plug and socket comprising the plug of the first aspect of the invention and a socket of the second aspect of the invention.

BRIEF DESCRIPTION OF THE DRAWINGS

One embodiment of the invention will now be described, by way of example only, with reference to the accompanying drawings in which.

DETAILED DESCRIPTION

Figure 1:
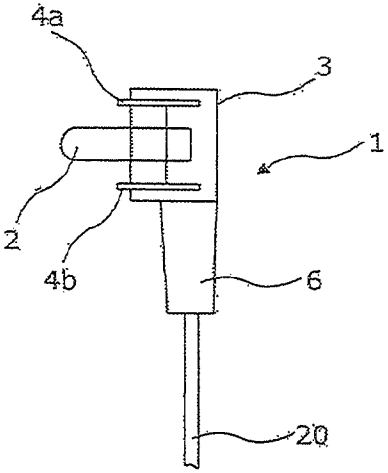
FIG. 1 is a cross-section of a plug for electrical equipment.

With reference to FIG. 1 there is shown a single pin jack plug for electrical equipment, and in particular for an audio headset (not illustrated). The plug 1 comprises a pin 2 and the pin forms an electrical terminal contact, which serves as a ground terminal. The plug 1 further comprises a housing 3. As will be described in more detail below, the plug 1 is arranged to be received in a socket, or jack, 10, wherein the pin and the housing are configured to enable the pin to be pivoted or levered in quick-release fashion and so minimise any potential damage to the plug, the socket and/or the cable because of the plug being inadvertently pulled out of the socket. The particular embodiment detailed here may be termed an audio plug and jack.

The plug further comprises two electrical terminal contacts, referenced as 4*a* and 4*b*. In the context of the plug 1 serving as a plug for a headphone set, each contact receives left and right channel signals respectively. The contacts are arranged to electrically connect to contacts 11*a* and 11*b* respectively providing on an externally facing surface of the socket 10. The contacts 11*a* and 11*b* are arranged to supply electrical signals (representative of audio material) to the respective contacts 4*a* and 4*b*. An internal electrically conductive surface 12 of a cylindrical recess 14 of the socket 10 is arranged to make electrical contact with the pin 2.

Returning to the detail of the plug 1, a sub-portion of the housing comprises a casing 6 which is arranged to house the electrical cable 20 at its point of entry to the plug (and ultimately for onward connection to the terminal contacts) at a cable entry region 6*a*. The casing 6 extends in a direction which is generally orthogonal of the longitudinal axis A-A of the pin 2 (which, with the pin 2 in the socket, is also the longitudinal axis of the socket recess 14).

Figure 4:
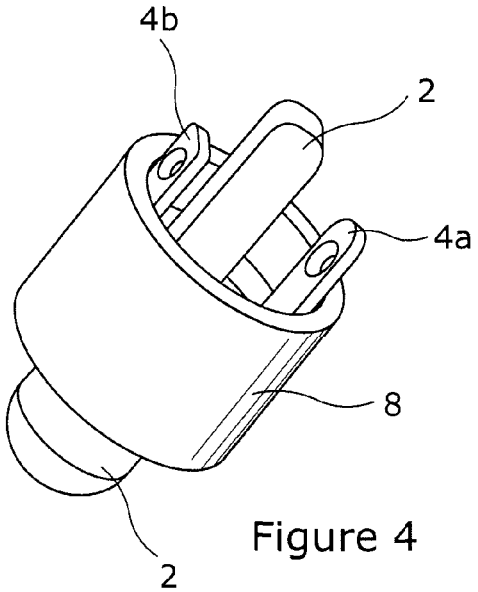
FIG. 4 is a perspective view of a sub-assembly of the plug of FIG. 1.
Figure 5:
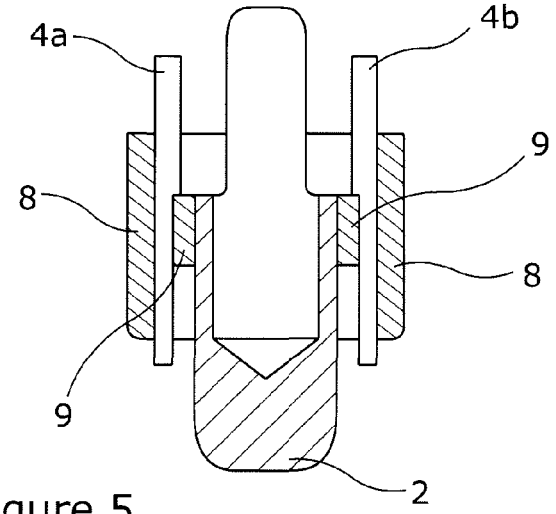
FIG. 5 is a longitudinal cross-section of the sub-assembly of FIG. 4.
Figure 6:
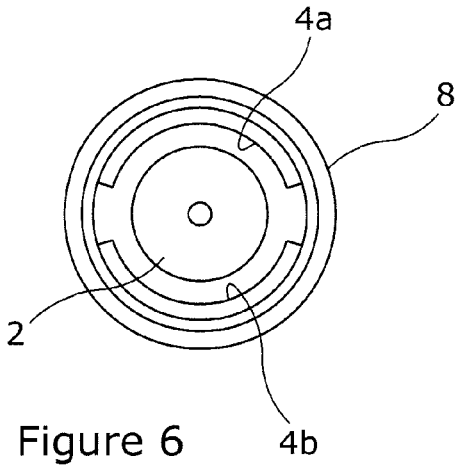
FIG. 6 is an end view of the sub-assembly of FIG. 4.

FIGS. 4, 5 and 6 show more detailed views a sub-assembly of the plug 1, and in particular detailing the pin 2 and the terminal contacts 4*a* and 4*b*. As shown in FIG. 5, the sub-assembly comprises an outer cylindrical housing 8. The terminal contacts 4*a* and 4*b*, which are of arcuate shape (as seen in FIG. 5) are provided adjacent to the housing 8. The arcuate contacts are provided rearwardly of the tip of the pin on a forward-facing surface of the plug. It is to be noted that the external ends of the contacts 4*a* and 4*b* protrude slightly from the end of the housing 8. It is further to be noted that the contacts 4*a* and 4*b* are of resilient form along their length, or at least at the external ends, to ensure that when compressed they exert an oppositely directed force to ensure good electrical contact with an opposed contact of the socket (and in particular a respective one of the contacts 11*a* and 11*b*). Moving radially inwards of the sub-assembly, a cylindrical insulating element 9 separates the pin 2 from the contacts 4*a* and 4*b*.

The diameter of the pin 2 is in the range 3 mm to 7 mm, although other pin diameters could equally be used.

The socket 10 is mounted in a supporting structure 30. The socket 10 comprises a female location feature 17 which serves to receive a complimentary male formation (not illustrated) of the plug 1. This ensures that the contacts 4*a* and 4*b* are aligned with, and correctly contact the contacts 11*a* and 11*b*, and that there is no bridging between contacts, such as contact 4*a* contacting with arcuate contacts 11*a* and 11*b*.

Figure 7:
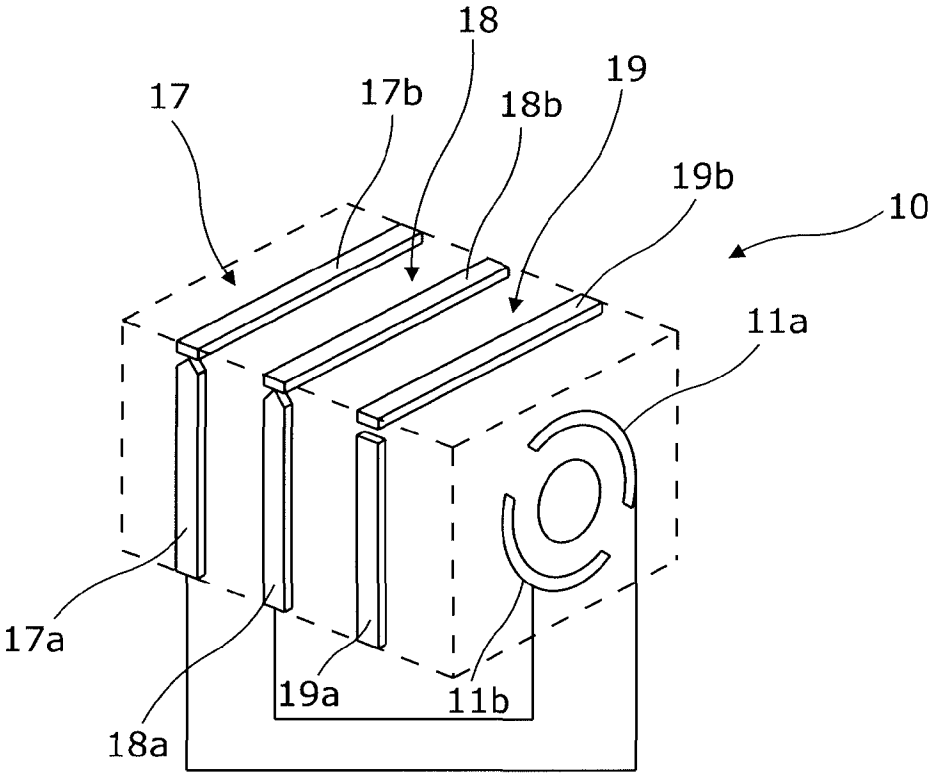
FIG. 7 is a schematic perspective view of a sub-assembly of a socket.

Further details of the electrical contact arrangement of the socket 10 is shown in FIG. 7, the arrangement comprising terminals 17, 18 and 19, which are spaced along the longitudinal axis of the socket. The terminal 17 comprises terminal contacts 17*a* and 17*b*, the terminal 18 comprises terminal contacts 18*a* and 18*b* and the terminal 19 comprises terminal contacts 19*a* and 19*b*. The terminal contacts referenced 'a' are static terminal contacts, whilst those marked 'b' are resiliently deflectable terminal contacts. The terminal contact 17*a* is connected to the arcuate contact 11*a*, whilst the terminal contact 18*a* is connected to the arcuate contact 11*b*. The terminal contact 17*a* serves to provide a first signal (such as a left audio channel signal) and the terminal contact 18*a* serves to provide a second signal (such as a right channel signal) On insertion of the plug 1 into the socket, electrical contact between the arcuate contacts 4*a* and 4*b* of the plug and the arcuate contacts 11*a* and 11*b* provides for the respective signals being supplied to the headphones from the contacts 17*a* and 18*a*. Also, on insertion, the pin 2 contacts and deflects the terminal contact 19*b* so that an electrical connection is effected between the pin and the contact 19*b* by way of the resilience of the contact applying a restoring force against the pin.

Figure 8:
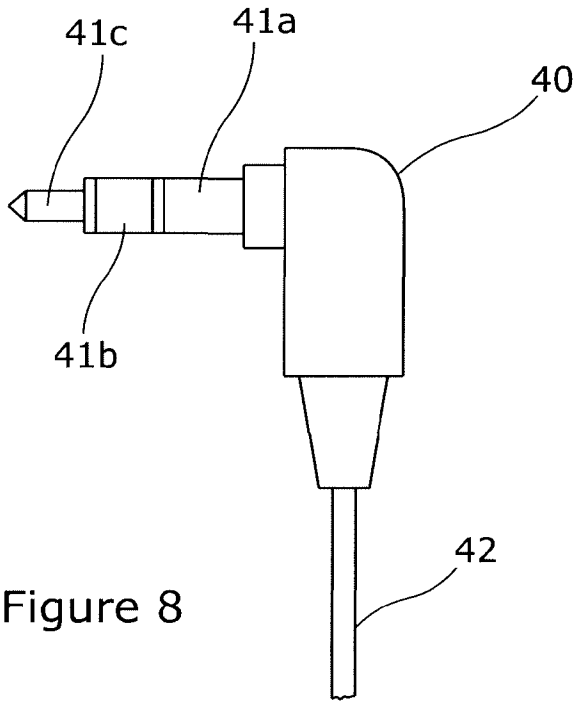
FIG. 8 is a side elevation of a plug

Advantageously, the socket 10 is backwards compatible in that it is capable of also allowing a known plug to be used therewith, of the type which comprise a pin in which the various terminals are spaced along the length of the pin (and electrically isolated from each other). On insertion of such a known plug type, each of the terminals of the pin will contact a respective terminal contact 17*b*, 18*b* and 19*b* (and so the left and right channel signals are provided by way of contact between the pin and the internal terminals of the socket. The socket 10 therefore has the versatility to accept the plug 1, or a known plug type, and so is not restricted to use of the former. An example of such a known plug type is shown in FIG. 8 which comprises a housing 40, a pin 41 comprising terminal contacts 41*a*, 41*b* and 41*c* spaced along the pin, the plug attached to a cable 42.

Figure 2:
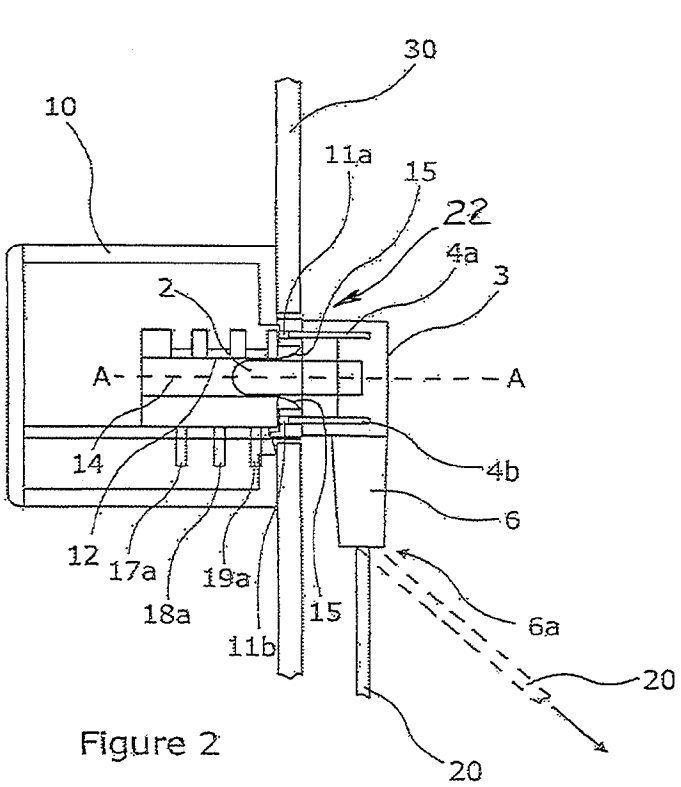
FIG. 2 is a cross-section of the plug of FIG. 1 connected in a socket.
Figure 3:
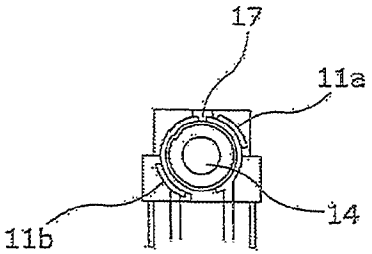
FIG. 3 is an end view of the socket of FIG. 2.

Should a user, for example whilst wearing the headphones, with the plug is inserted in the socket, inadvertently attempt to take the headphones beyond the length of the cable, as shown by the broken line representation in FIG. 2, the cable applies a force at the cable entry region 6*a*. This then causes a leverage to be applied to the plug by way of the length of the casing 6. This in turn causes the casing (and therefore the plug itself) to turn laterally of the axis A-A of the socket 10. In so doing engagement between opposing surfaces of the plug and the socket form a fulcrum in the region at 22, and the mechanical leverage brought about by the length of the casing 6 allows the user to pivot the plug out of the socket. This intentional facilitated removal, or quick-release, of the plug is achieved by ensuring that there is enough leverage length from the casing 6 to the fulcrum. It is also achieved by selecting an effective length of the pin 2 which is sufficient to make the ground connection and ensure that there is sufficient frictional engagement with the surface to ensure that plug stays in position. The radiused end portion of the pin 2 assists in this removal procedure, as does the curved mouth 17 of the socket. Because the plug is caused to exit and become detached from the socket, any damage to the cable, the plug and/or the socket is minimised or avoided.

Although the above embodiment finds particular application in the field of headphones (and is of particular advantage in the field of (inflight or otherwise) passenger entertainment), modified embodiments also find application in relation to plug and socket arrangements for transmission of data generally, or indeed any electrical signal, and not solely audio signals and/or power.

The invention claimed is:

1. A plug for electrical equipment, the plug comprising a pin and the pin comprising an electrical terminal contact, the plug further comprising a housing, the plug arranged to be received in a socket, wherein the pin and the housing are configured to enable the pin to be pivoted out of the socket by way of a force applied to a cable entry region of the plug by a cable attached to the plug, wherein the housing forms a lever portion from the cable entry region, the lever portion is orthogonal to the longitudinal axis of the pin, which lever portion is intended to serve as a lever to enable the pivotable removal of the pin from the socket, and further wherein the pin comprises a radiused end portion located at a distal end of a cylindrical portion of the pin, and the cylindrical portion arranged to be brought into electrical connection with a contact of the socket, the cylindrical portion of the pin comprises an outer electrical contact surface arranged to be brought into electrical connection with an internal electrical terminal of a socket, and the plug comprises at least one further electrical terminal contact which is radially spaced from the outer electrical contact surface of the pin, and which further electrical terminal contact is spaced in the direction of the longitudinal axis of the pin from the distal end of the pin.

2. A plug as claimed in claim 1 in which an effective length of the pin relative to a dimension of the housing arranged so as to enable the pin to be pivotably releasable from the socket.

3. A plug as claimed in claim 2 in which the effective length of the pin is shorter than said length of the housing.

4. A plug as claimed in claim 1 in which the lever portion comprises a cable casing to receive the cable.

5. A plug as claimed in claim 1 arranged to remain in a connected condition in the socket by way of frictional engagement between the pin and an inner surface of the socket.

6. A plug as claimed in claim 5 in which at least two further electrical contacts are provided.

7. A plug as claimed in claim 1 in which the at least one further electrical terminal contact is arranged to face the same general direction as the longitudinal extent of the pin.

8. A plug as claimed in claim 7 in which the at least one further electrical contact terminal is of substantially arcuate form.

9. A plug as claimed in claim 1 in which the at least one further electrical terminal contact is resilient in a direction of electrical engagement with a contact of the socket.

10. A plug as claimed in claim 1 in which the electrical terminal contact of the pin is a ground terminal.

11. An electrical socket which comprises a plurality of internal terminal contacts spaced along a longitudinal axis of the socket arranged to be capable of electrical contact with respective portions of a pin of a plug insertable into the socket, and at least one of the internal terminal contacts connected to an external terminal contact of the socket, which external terminal contact arranged to contact with a terminal contact of the plug of claim 1, the terminal contact of the said plug not provided on the pin of said plug, and the socket also capable of use with a plug for which electrical connection between the plug and the socket is effected solely by way of electrical contact between the internal terminal contacts and respective portions of a pin of the plug.

12. A plug for electrical equipment, the plug comprising a pin and the pin comprising an electrical terminal contact, the plug further comprising a housing, the plug arranged to be received in a socket, wherein the pin and the housing configured to enable the pin to be pivoted out of the socket by way of a force applied to a cable entry region of the plug by a cable attached to the plug, wherein the housing forms a lever portion from the cable entry region, the lever portion is orthogonal to the longitudinal axis of the pin, which lever portion is intended to serve as a lever to enable the pivotable removal of the pin from the socket, and further wherein the pin comprises a radiused end portion located at a distal end of a cylindrical portion of the pin, and the cylindrical portion arranged to be brought into electrical connection with a contact of the socket, further comprising a location feature to engage with the socket so as to enable a required orientation of the plug to the socket to be achieved when the plug is connected to the socket.

* * * * *